US005636974A

United States Patent [19]

Ikeda et al.

[11] Patent Number: 5,636,974

[45] Date of Patent: Jun. 10, 1997

[54] RECIPROCATING PISTON TYPE COMPRESSOR WITH AN OIL SEPARATOR FOR REMOVING LUBRICATING OIL FROM DISCHARGED HIGH PRESSURE REFRIGERANT GAS

[75] Inventors: Hayato Ikeda; Hirofumi Sato; Tomoji Tarutani; Hiromi Michiyuki, all of Kariya, Japan

[73] Assignee: Kabushiki Kaisha Toyoda Jidoshokki Seisakusho, Aichi-ken, Japan

[21] Appl. No.: 658,197

[22] Filed: Jun. 4, 1996

[30] Foreign Application Priority Data

Jun. 8, 1995 [JP] Japan ..... 7-141737

[51] Int. Cl.[6] ..... F04B 53/18

[52] U.S. Cl. ..... 417/269; 417/313; 92/154; 184/6.23

[58] Field of Search ..... 417/313, 269; 92/154; 184/6.23

[56] References Cited

U.S. PATENT DOCUMENTS 5,009,286 4/1991 Ikeda et al. ..... 417/269

FOREIGN PATENT DOCUMENTS 2153273 6/1990 Japan .

3-9084 1/1991 Japan ..... 417/269

3-11167 1/1991 Japan ..... 417/269

3-61680 3/1991 Japan ..... 417/269

5-195949 8/1993 Japan ..... 417/269

5-240158 9/1993 Japan ..... 417/269

6-10835 1/1994 Japan ..... 417/269

*Primary Examiner*—Charles G. Freay

*Assistant Examiner*—Roland G. McAndrews, Jr.

*Attorney, Agent, or Firm*—Burgess, Ryan and Wayne

[57] ABSTRACT

A reciprocating piston compressor adapted to receive a low pressure gas from an external circuit, and to supply a high pressure gas to the external circuit includes a cylinder block with front and rear ends. The cylinder block includes a central bore extending along the longitudinal axis, and a plurality of axially extending cylinder bores. The central bore has an open end at the front end of the cylinder block and an opposite closed end. Pistons are slidably provided within the cylinder bores for reciprocation. A drive shaft is inserted into the central bore for driving the motion of the reciprocating pistons. A pair of radial bearings, which are provided in the central bore, supports the axially extending drive shaft. An oil separator is provided between the compressor and the external circuit to remove lubricating oil contained in the high pressure gas. An oil reservoir is provided for accumulating the lubricating oil removed from the high pressure gas by the oil separator, the cylinder block including at least a portion of the oil reservoir adjacent to the blind end of the central bore.

9 Claims, 4 Drawing Sheets

RECIPROCATING PISTON TYPE COMPRESSOR WITH AN OIL SEPARATOR FOR REMOVING LUBRICATING OIL FROM DISCHARGED HIGH PRESSURE REFRIGERANT GAS

BACKGROUND OF THE INVENTION

1. Field of the Invention

The present invention relates to an improvement of a reciprocating piston type compressor with an oil separator for removing lubricating oil from high pressure refrigerant gas discharged from the compressor.

2. Description of the Related Art

A reciprocating type refrigerant compressor is generally used for supplying compressed refrigerant gas to a refrigerating circuit in an air conditioning system for an automobile. Such a compressor, in general, comprises a cylinder block including a plurality of parallel cylinder bores arranged around the longitudinal axis of the cylinder block, double-headed pistons which are slidable within the respective cylinder bores for reciprocation between the top dead center and the bottom dead center, and a drive mechanism for reciprocating the double-headed pistons. The drive mechanism includes a drive shaft which is supported for rotation by the cylinder block through a pair of radial bearings, and is operatively connected to a drive source, such as an automobile engine, and an inclined swash plate or cam plate mounted on the drive shaft. The inclined swash plate is engaged with the double-headed pistons through shoes mounted on the respective pistons, and is supported by a pair of thrust bearings.

A lubricating oil is used for lubrication of the moving elements, in particular, the radial and thrust bearings in the compressor. The lubricating oil collects in the swash plate chamber after it is distributed to the radial and thrust bearings. Then, the lubricating oil in the swash plate chamber is entrained by the low pressure refrigerant gas from the external refrigerating circuit during the compressing process so that the discharged high pressure refrigerant gas contains the lubricating oil in the form of a mist. The lubricating oil a mist in the high pressure refrigerant gas tends to attach to inner surfaces of the refrigerating circuit in the air conditioning system, which will decrease the heat exchange efficient of the refrigerating circuit if the lubricating oil is not removed from the refrigerant gas before it is supplied to the refrigerating circuit.

Accordingly, in a prior art compressor, an oil separator is provided, separately from the compressor in a high pressure pipe between the compressor and the refrigerating circuit, for removing the lubricating oil from the high pressure refrigerant gas discharged from the compressor before it is supplied to the refrigerating circuit. The removed oil is returned to the compressor through an oil return pipe. However, the oil return pipe tends to be blocked since the return pipe has a small inner diameter and a relatively long length due to the arrangement of the refrigerating circuit around the compressor.

Thus, a compressor which has an oil separator integrally formed therein has been developed. Such a compressor with an oil separator integrally formed therein includes an oil reservoir provided the rear housing which is connected to the rear end face of the cylinder block. However, the compressor encounters a problem in that provision of an oil sump or reservoir to accumulate a relatively large volume of the lubricating oil in the compressor results in an increase in the volume of the compressor because of the space for the oil reservoir in the compressor.

Further, a long term suspension of operation of the compressor makes the lubricating oil flow out from the oil reservoir into a central swash plate chamber through a passage for supplying the lubricating oil to the bearings. A reverse flow of the high pressure refrigerant gas occurs from the oil separator into the central swash plate chamber through the empty oil reservoir and passage when the compressor starts after a long term suspension of operation. A provision of valve mechanism for preventing the reverse flow will decrease the reliability of the compressor because of a possible failure of the valve mechanism.

Furthermore, within the central swash plate chamber, the low pressure refrigerant gas, which flows along the wall of the central swash plate chamber, tends to prevent the lubricating oil from reaching the bearing. The poor distribution of the lubricating oil inhibits the use of plain or slide bearings for the radial and thrust bearings instead of roller or ball bearings.

SUMMARY OF THE INVENTION

The invention is directed to solve the prior art problem described above, and to provide a reciprocating compressor improved to have a relatively large oil reservoir without increasing the volume of the compressor.

Another objective of the invention is to provide a reciprocating compressor improved to prevent the reverse flow of the refrigerant gas from the oil separator to the central inclined swash plate when the compressor starts after a long term suspension of operation.

Another objective of the invention is to provide a reciprocating compressor including an oil circulation system which can distribute the lubricating oil sufficiently to the bearings.

According to the invention, there is provided a reciprocating piston compressor adapted to receive a low pressure gas from an external circuit, and to supply a high pressure gas to the external circuit. The compressor includes a cylinder block with front and rear ends. The cylinder block includes a central bore extending along the longitudinal axis, and a plurality of axially extending cylinder bores arranged around the central bore. The central bore has an open end at the front end of the cylinder block and an opposite closed end. Housing means is sealingly mounted to the ends of the cylinder block by screw bolts with valve plates clamped between the cylinder block and the housing means. The cylinder block further includes axially extending bolt insertion holes which are arranged around the central bore, for receiving the screw bolts. The bolt insertion holes have a diameter larger than that of the screw bolts to define annular spaces between the bolt insertion holes and the screw bolts inserted. A plurality of pistons are slidably provided within the cylinder bores for reciprocation. An axially extending drive shaft is inserted into the central bore for driving the motion of the reciprocating pistons. A pair of radial bearings, which are provided in the central bore, supports the axially extending drive shaft. An oil separator is provided between the compressor and the external circuit to remove lubricating oil in the form of a mist contained in the high pressure gas. An oil reservoir is provide for accumulating the lubricating oil removed from the high pressure gas by the oil separator, the cylinder block including at least a portion of the oil reservoir adjacent to the blind end of the central bore. Oil passages are provided between the central bore and the oil reservoir for distributing the lubricating oil to the radial bearings. The oil passages include an orifice provided in the cylinder block between the blind end of the central bore and the oil reservoir, and a pair of passages extending along the front and rear ends of the cylinder block. One of the pair of passages at the rear end of the cylinder block fluidly connects at least one of the bolt insertion holes to the oil reservoir. The other passage fluidly connects the one of the bolt insertion holes to the central bore adjacent to the opening thereof. Thus, the a portion of the lubricating oil is supplied to the central bore from the oil reservoir through at least one of the annular spaces between the at least one bolt insertion holes and the screw bolts inserted.

According to the invention, the lubricating oil is distributed to the radial bearings, which are provided within the central bore, from the oil reservoir, at least a portion of which is formed in the cylinder block adjacent to the blind end of the central bore, through the passages. Thus, the capacity of the oil reservoir can be increased compared with the prior art compressor without increasing the overall volume of the compressor.

Further, the oil passages are connected to the central bore at ends of the central bore outside the portions where the radial and thrust bearings are displaced. The radial and thrust bearings provide a pressure drop in the flow through them to prevent the reverse flow from the oil separator to the central inclined swash plate when the compressor starts after a long term suspension of operation.

DESCRIPTION OF THE DRAWINGS

These and other objects and advantages and further description will now be discussed in connection with the drawings in which.

DESCRIPTION OF THE PREFERRED EMBODIMENTS

Figure 1:
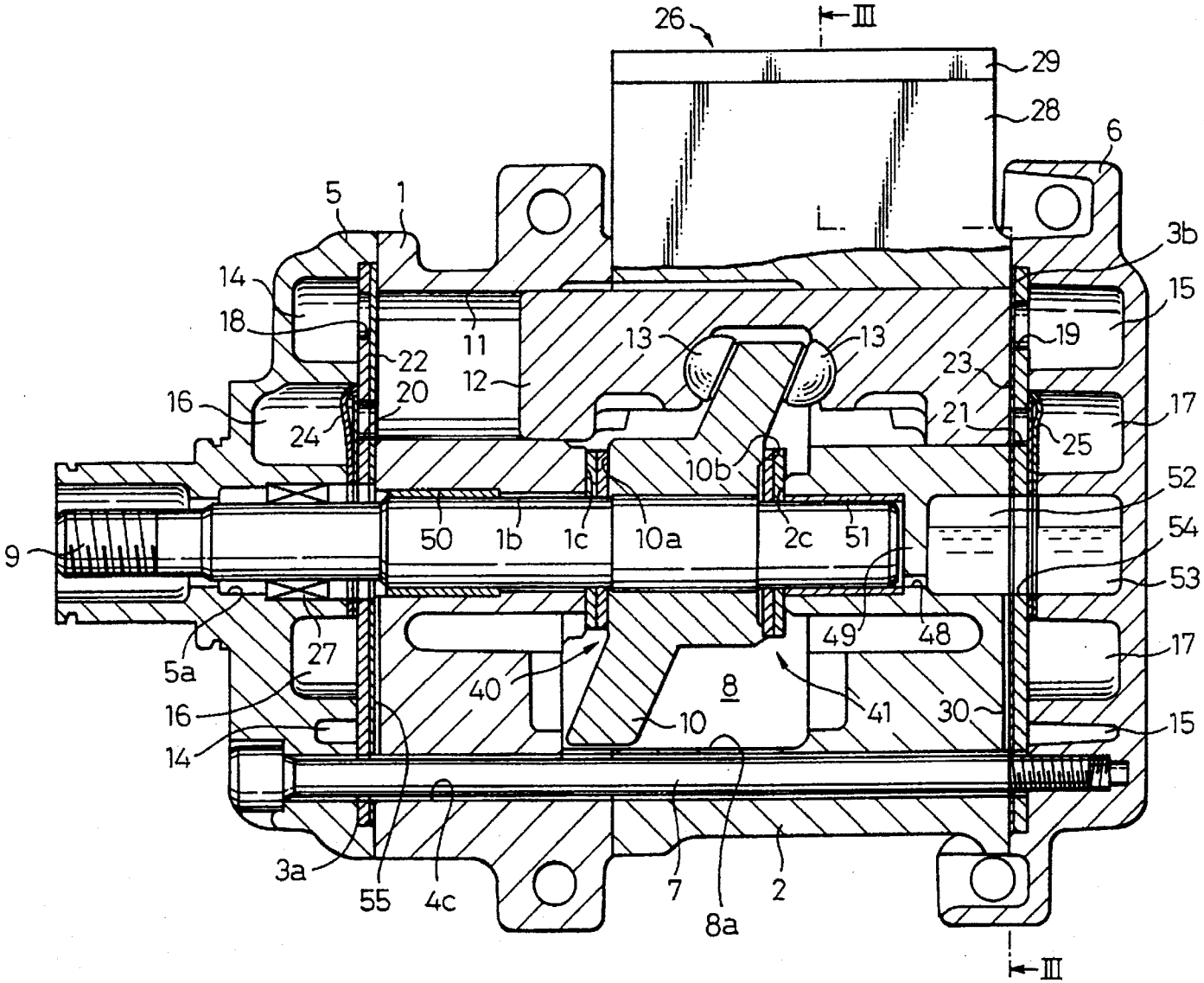
FIG. 1 is a longitudinal section of the compressor according to the invention along line I—I in FIG. 3.
Figure 2:
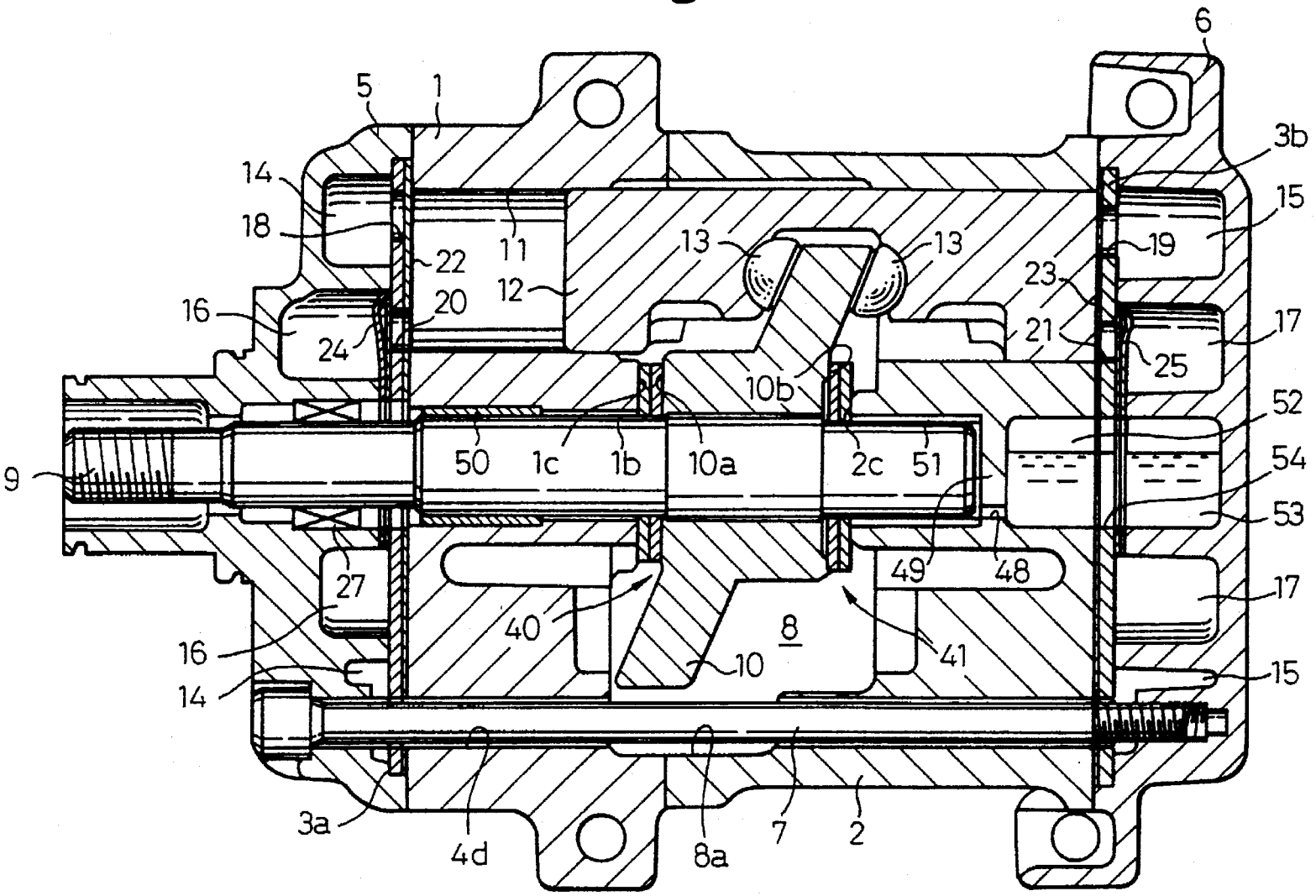
FIG. 2 is a longitudinal section of the compressor according to the invention along line II—II in FIG. 3.
Figure 3:
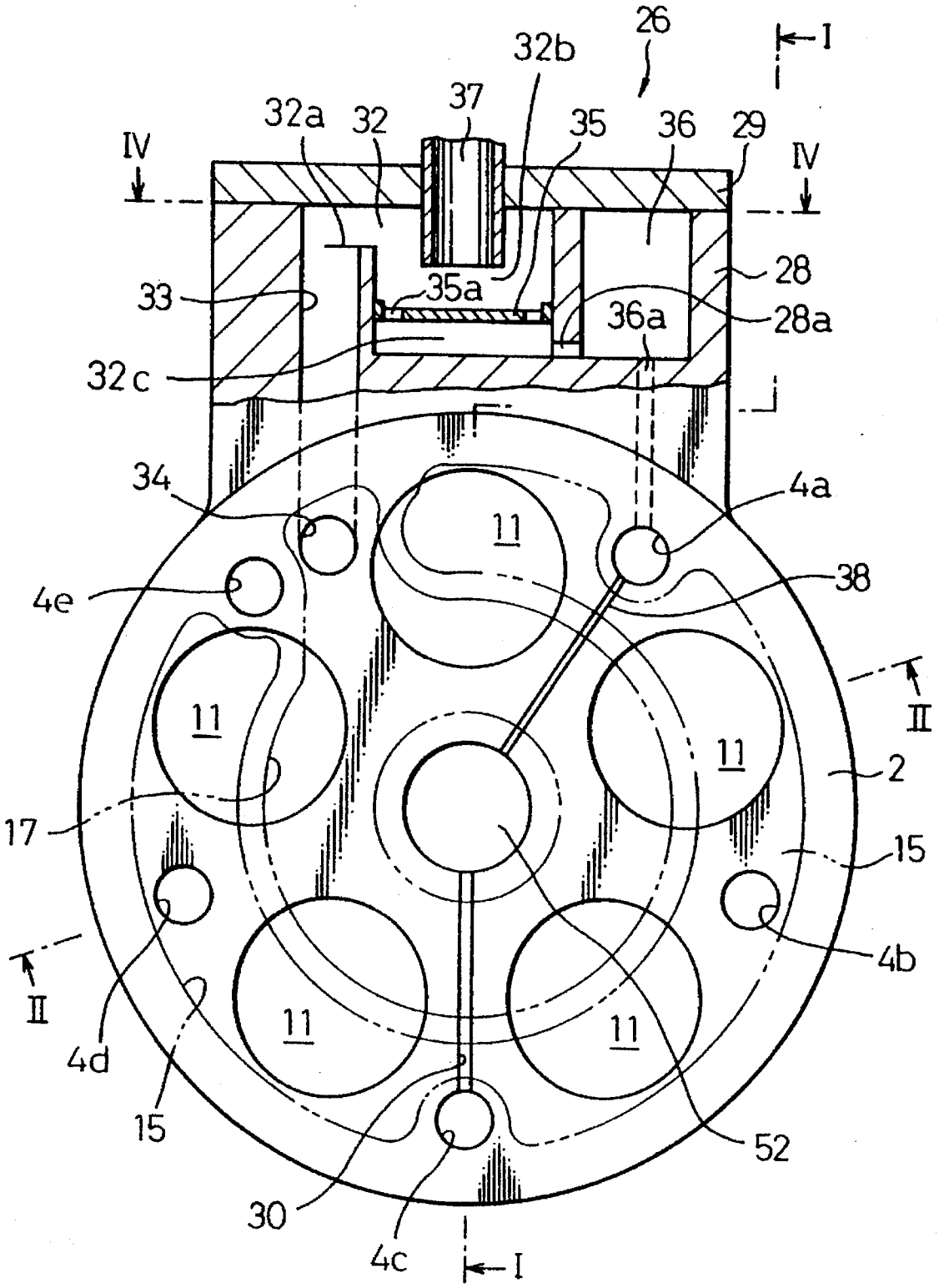
FIG. 3 is a side section of the compressor according to the invention along line III—III in FIG. 1.
Figure 4:
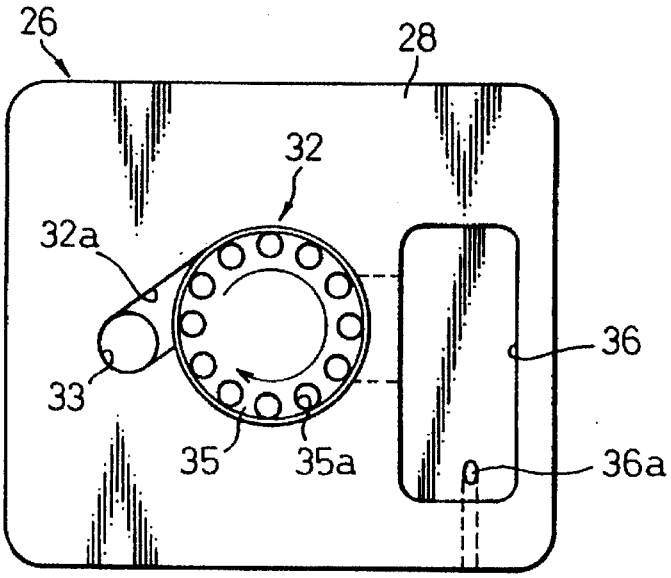
FIG. 4 is a top view of the oil separator for the compressor according to the invention.

With reference to FIGS. 1, 2 and 3, a double-headed piston inclined swash plate type refrigerant compressor is provided with front and rear cylinder blocks 1 and 2 axially connected together by means of screw bolts 7, in the illustrated embodiment, five screw bolts, to form an integral cylinder block assembly. The integral cylinder block assembly 1 and 2 has front (left in FIGS. 1 and 2) and rear (right in FIGS. 1 and 2) end faces, and includes a central bore 1*a*.

The central bore la extends along the longitudinal axis of the integral cylinder block assembly 1 and 2, and has a front end which opens in the front end face of the integral cylinder block assembly 1 and 2, and a rear end closed by a wall 49. A drive shaft 9 is inserted into the central bore la from its front open end so that the drive shaft 9 is mounted to the integral cylinder block assembly 1 and 2 for rotation by a pair of radial bearings 50 and 51.

Front and rear housings 5 and 6 are sealingly mounted to the front and rear ends of the integral cylinder block assembly 1 and 2, respectively. A pair of valve plates 3*a* and 3*b* are clamped between the integral cylinder block assembly 1 and 2 and the housings 5 and 6. The screw bolts 7 are inserted into bolt insertion holes 4*a*, 4*b*, 4*c*, 4*d* and 4*e* which are arranged around the central bore 1*a* to extend parallel to the longitudinal axis from the front housing 5 through the cylinder block assembly 1 and 2 to the rear housing 6. The bolt insertion holes have a diameter which is larger than the outer diameter of the inserted screw bolts 7.

A front end of the drive shaft 9 extends outwardly through a housing bore 5*a* included in the front housing 5 so that the compressor can be operatively connected to a rotary drive source, such as an automobile engine (not shown) via an appropriate transmission mechanism (not shown). A seal 27 is provided in the housing bore 5*a* to prevent the refrigerant gas from leaking between the housing bore 5*a* and the drive shaft 9.

A plurality of axially extending parallel cylinder bores 11, in the illustrated embodiment, five cylinder bores, are equally spaced in the integral cylinder block assembly 1 and 2 about the drive shaft 9. Within the cylinder bores 11, double-headed pistons 12 are slidably provided for reciprocation between top and bottom dead centers. The inner surface of the cylinder bores 11 and the ends of the double-headed pistons 12 define compression chambers.

The integral cylinder block assembly 1 and 2 further includes a central swash plate chamber 8. The central swash plate chamber 8 is fluidly connected to an evaporator (not shown) arranged in an external refrigerating circuit through a suction passage (not shown). Within the central swash plate chamber 8 an inclined swash plate 10, as a cam plate, is mounted on the drive shaft 9 to rotate therewith. The inclined swash plate 10 engages the double-headed pistons 12 through shoes 14 which are socketed in the respective pistons 12. Thus, the rotation of the drive shaft 9 is converted into the reciprocation of the double-headed pistons 12 within the cylinder bores 11 via the inclined swash plate 10.

A pair of slide type thrust bearings 40 and 41 is provided, between the inclined swash plate 10 and the integral cylinder block assembly 1 and 2, for bearing a thrust load on the inclined swash plate 10. The front and rear cylinder blocks 1 and 2 define inner abutment faces 1*c* and 2*c* respectively while the inclined swash plate 10 defines front and rear abutment faces 10*a* and 10*b*. The thrust bearings 40 and 41 are clamped between the inner abutment face 1*c* of the front cylinder block 1 and the front abutment face 10*a* of the inclined swash plate 10, and between the inner abutment face 2*c* of the rear cylinder block 2 and the rear abutment face 10*b* of the inclined swash plate 10, respectively.

As can be seen in FIGS. 1 and 2 the inner abutment face 1*c* of the front cylinder block 1 and the front abutment face 10*a* of the inclined swash plate 10 are formed so that these faces abut against the thrust bearing 40 over the entire surfaces. The thrust bearing 40 is clamped rigidly between the front cylinder block 1 and the inclined swash plate 10. On the other hand, the inner abutment face 2*c* of the rear cylinder block 2 is formed so that it contacts only the radially inner portion of the thrust bearing 41, and the rear abutment face 10*b* is formed to contact only the radially outer portion of the thrust bearing 41. Thus, the thrust bearing 41 is clamped between the rear cylinder block 2 and the inclined swash plate 10 so that, during the operation, it can axially deform to absorb an axial impact load applied on the inclined swash plate 10.

Figure 5:
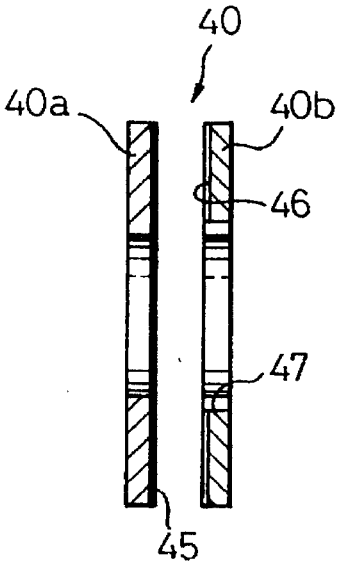
FIG. 5 is a longitudinal section of the thrust bearing used for the compressor according to the invention.
Figure 6:
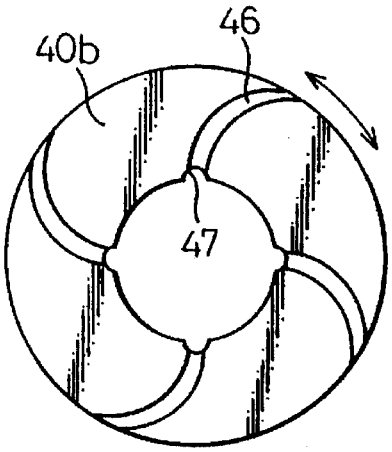
FIG. 6 is side view of a outer disc of the thrust bearing of FIG. 5.

With reference to FIGS. 5 and 6, the configuration of the thrust bearing is illustrated. In FIGS. 5 and 6, only the thrust bearing 40 is illustrated since the thrust bearings 40 and 41 are substantially identical to each other. The thrust bearing 40 comprises a first or a outer disc 40*a* and a second or an inner disc 40*b* in the form of rings. The outer and inner disc 40*a* and 40*b* have an inner diameter slightly larger than the outer diameter of the drive shaft to provide a small clearance between the drive shaft 9 and the thrust bearings 40 and 41 The outer disc 40*a* can be provided a surface coating 45 of a fluororesin, preferably, polytetrafluoroethylen, on the inner end face for reducing the friction between the outer and inner discs 40*a* and 40*b*, which contact to each other when assembled. The inner disc 40*b* includes a plurality of axial grooves 47 on its inner diameter and a plurality of curved grooves 46 on the outer end face against which the outer disc 40*a* abuts.

The compressor further includes front and rear suction chambers 14 and 15, and front and rear discharge chambers 16 and 17, which are defined, substantially in the form of rings, by the valve plates 3*a* and 3*b* and the front and rear housings 5 and 6. In FIG. 3, only the rear suction chamber 15 and the rear discharge chamber 17 are illustrated by dotted curves. The valve plates 3 and 4 include suction openings 18 and 19, through which the low pressure refrigerant gas is introduced into the compression chambers within which the double headed pistons 12 move toward the bottom dead centers, and discharge openings 20 and 21, through which the compressed high pressure refrigerant gas is discharged into the discharge chambers 16 and 17 from the compression chambers within which the double headed pistons 12 move toward the top dead centers. Suction valves 22 and 23 are provided on the inside surfaced of the valve plates 3*a* and 3*b*, and discharge valves 24 and 25 are provided on the outside surface of the valve plates 24 and 25.

The bolt insertion holes 4*a*, 4*c* and 4*e* are fluidly separated from the central swash plate chamber 8 by walls 8*a*, and provide a first group of bolt insertion holes. The bolts 4*b* and 4*d* are provided for fluid communication with the central swash plate chamber 8, as shown in FIG. 2, and provide a second group of the bolt insertion holes. Preferably, the bolt insertion holes 4*a*, 4*c* and 4*e* of the first group and the bolt insertion holes 4*b* and 4*d* of the second group are alternatively arranged and equally spaced about the drive shaft 9. In particular, with reference to FIG. 3, two bolt insertion holes 4*a* and 4*e* of the first group are displaced in the upper portion while the remaining one 4*c* is displaced at the lower portion of the integral cylinder block assembly 1 and 2. The bolt insertion holes 4*b* and 4*d* of the second group are displaced between the bolt insertion holes 4*a* and 4*c*, and between the bolt insertion holes 4*c* and 4*e*, respectively.

The bolt insertion holes 4*b* and 4*d* of the second group open into the front and rear suction chambers 14 and 15. When assembled, the gap between the inner surface of the bolt insertion holes 4*b* and 4*d* and the outer surface of the screw bolts 7 inserted provides a fluid communication between the front and rear suction chambers 14 and 15 through the central swash plate chamber 8. The low pressure refrigerant gas is directed to the front and rear suction chambers 14 and 15 from the evaporator of the external refrigerating circuit through the central inclined swash plate 8 and the bolt insertion holes 4*b* and 4*d* of the second group.

On the other hand, the front and rear discharge chambers 16 and 17 are fluidly connected to each other by a first high pressure refrigerant gas passage 34 (see FIG. 3) which extends through the integral cylinder block assembly 1 and 2 parallel to the drive shaft 9. Further, the front and rear discharge chambers 16 and 17 are connected a condenser (not shown) arranged in the external refrigerating circuit (not shown) through a high pressure refrigerant gas pipe 37 as described below.

A centrifugal type lubricating oil separator 26 is provided for removing lubricating oil in the form of a mist entrained by the high pressure refrigerant gas discharged from the discharge chambers. In particular, with reference to FIG. 3, the lubricating oil separator 26 comprises a housing 28 which is integrally connected to the rear integral cylinder block assembly 1 and 2, and a top wall 29 for closing the top openings of the housing 28.

The housing 28 includes a cylindrical swirl chamber 32 with a cylindrical wall, and a primary oil reservoir 36 adjacent to the swirl chamber 33. A circular partition wall 35, which includes a plurality of small apertures 35*a* along the peripheral portion thereof, is provided for dividing the swirl chamber 32 into upper and lower chambers 32*b* and 32*c*. An orifice 28*a* is provided, as shown in FIG. 3, between the swirl chamber 32 and the primary oil reservoir 36 to connect them to each other.

The housing 28 further includes a tangential inlet port 32*a* which opens into the swirl chamber 32 tangentially to the cylindrical wall of the swirl chamber 32. A second high pressure refrigerant gas passage 33 is provided between the tangential inlet port 32*a* and the first high pressure refrigerant gas passage 34. The high pressure refrigerant gas pipe 37 is provided for connecting the swirl chamber 32 to the condenser of the external refrigerating circuit. In FIG. 3, one end of the high pressure refrigerant gas pipe 37 extends into the swirl chamber 32 through the top wall 29.

The first high pressure refrigerant gas passage 34, the second high pressure refrigerant gas passage 33 and the tangential inlet port 32 provide a fluid communication between swirl chamber 32 and the front and rear discharge chambers 16 and 17. The tangential inlet port 32*a* directs the high pressure refrigerant gas from the front and rear discharge chambers 16 and 17 into the swirl chamber 32 to make a swirl flow of the refrigerant gas within the swirl chamber 32.

A first oil passage 36*a* is provided between the primary oil reservoir 36 and one of the bolt insertion holes of the first group, in particular, the bolt insertion hole 4*a*, which is displaced beneath the primary oil reservoir 36.

Referring to FIG. 1, the rear cylinder block 2 includes a recess 52 axially aligned to the central bore 1*a*. The recess 52 is separated from the central bore 1*a* by the wall 49 which also closes the rear end of the central bore 1*a*. The recess 52 outwardly opens at the rear end of the rear cylinder block 2. The rear housing 6 includes a central recess 53 which is aligned to the recess 52 of the rear cylinder block 2, and has a diameter equal to that of the recess 52. The valve plate 3*b* between the rear cylinder block 2 and the rear housing 6 includes a central opening 54 Which is also aligned to the recesses 52 and 53, and has a diameter equal to that of the recesses 52 and 53.

The recesses 52 and 53 and the central opening 54 provide a secondary oil reservoir. The secondary oil reservoir is fluidly connected to the bolt insertion hole 4*a* through a second oil passage 38 (see FIG. 3). The second oil passage 38 is provided by a groove which extends along the rear end face of the rear cylinder block 2 between the rear end openings of the bolt insertion hole 4*a* and the recess 52. The second oil passage may be provided along the inner face of the valve plate 3*b* which is clamped between the rear cylinder block 2 and the rear housing 6.

An orifice 48 is provided in the wall 49 between the central bore 1*a* and the recess 52 in the rear cylinder block 2. The orifice 48 provides fluid communication between the secondary oil reservoir and the central bore 1*a* for directing the lubricating oil from the secondary oil reservoir to the rear end of the drive shaft 9.

The secondary oil reservoir is further connected to the bolt insertion hole 4*c*, which is displaced at the lower portion of the assembled cylinder block assembly 1 and 2, through a third oil passage 30. The third oil passage 30 is provided by a groove which extends between the bottom of the secondary oil reservoir and the bolt insertion hole 4*c* along the rear end face of the rear cylinder block 2.

A fourth oil passage 55 is provided at the front end face of the front cylinder block 1 for upwardly directing the lubricating oil from the bolt insertion hole 4*c* to the central bore la in the front cylinder block 1. The fourth oil passage 55 extends from the bolt insertion hole 4*c* to the central bore la along the front end face of the front cylinder block 1. The fourth oil passage 55 may be provided on the inner face of the valve plate 3*a* which is clamped between the front cylinder block 1 and the front housing 5.

The functional operation of the compressor according to the preferable embodiment of the invention will be described hereinafter.

Rotation of the drive shaft 9 is converted to the reciprocation of the double-headed pistons 12 within the cylinder bores 11 through the engagement between the inclined swash plate 10 and double-headed pistons 12.

The low pressure refrigerant gas is introduced into the compression chambers within which the double-headed pistons 12 move toward the bottom dead center from the evaporator in the external refrigerating system through the central swash plate chamber 8, bolt insertion holes 4*b* and 4*d*, suction chambers 14 and 15, and the suction openings 18 and 19.

The high pressure refrigerant gas compressed within the compression chambers within which the double-headed pistons 12 move toward the top dead center is discharged into the discharge chambers 16 and 17 through the discharge openings 20 and 21. From the discharge chambers 16 and 17, the high pressure refrigerant gas is directed to the oil separator 26 through the first and second high pressure refrigerant gas passages 34 and 33 and the tangential inlet port 32*a*. The tangential inlet port 32*a* directs the high pressure refrigerant gas tangentially into the swirl chamber 32 along the cylindrical wall of the swirl chamber 32 to promote a swirl flow of the high pressure refrigerant gas.

The swirl flow of the high pressure refrigerant gas generates a centrifugal force on the lubricating oil a mist contained in the refrigerant gas. Thus, the lubricating oil a mist in the high pressure refrigerant gas flow moves toward the cylindrical wall of the swirl chamber 32. The lubricating oil a mist, which has reached the cylindrical wall of the swirl chamber 32, moves downwardly along the wall to the lower chamber 32*b* of the swirl chamber 32, under the partition wall 35 and through the apertures 35*a*. On the other hand, the high pressure refrigerant gas flows out the swirl chamber 32 through the discharge pipe 37 to the condenser in the external refrigerating system. Thus, the lubricating oil is removed from the high pressure refrigerant gas before the refrigerant gas is supplied to the external refrigerating circuit from the compressor.

The lubricating oil removed from the high pressure refrigerant gas by centrifugal force moves into the lower chamber 32*c* of the swirl chamber 32 through the apertures 35*a* in the partition wall 35. From the lower chamber 32*c*, the lubricating oil flows into the primary oil reservoir 36 through the orifice 28*a*. Then, the lubricating oil flows into the secondary oil reservoir 52, 53 and 54 through the first oil passage 36*a*, the bolt insertion hole 4*a* and the second oil passage 38 to accumulate in the secondary oil reservoir.

A portion of the lubricating oil in the secondary oil reservoir flows into the central bore 1*b* at the rear end of the central bore toward the rear end of the drive shaft 9 through the orifice 48. The rotation of the drive shaft 9 reduces the pressure within the gap between the outer surface of the drive shaft 9 and the inner surface of the radial bearing 51 to attract the lubricating oil into the gap from the secondary oil reservoir. The lubricating oil in the gap further moves toward the thrust bearing 41, then flows into the axial grooves 47 in the outer disc 41*b*. The axial grooves 47 direct the lubricating oil to the curved grooves 46 to flow therealong under the centrifugal force. When the lubricating oil flows along the curved groove 46, the lubricating oil also flows out the groove into the interface between the outer and inner discs 41*a* and 41*b*. Then the lubricating oil flows into the central swash plate chamber 8.

It will be understood by those skilled in the art that the pressure difference between the swirl chamber 32 and the central swash plate chamber 8 also drives the lubricating oil from the swirl chamber 32 to the central swash plate chamber 8.

The remaining portion of the lubricating oil in the secondary oil reservoir flow into the central bore 1*b* in the front cylinder block 1 through the third oil passage 30, the bolt insertion hole 4*c* and the fourth oil passage 55. The rotation of the drive shaft 9 reduces the pressure within the gap between the outer surface of the drive shaft 9 and the inner surface of the radial bearing 50 to attract the lubricating oil into the gap from the secondary oil reservoir through the oil passages. The lubricating oil in the gap flows into the central swash plate chamber 8 as in case of the thrust bearing 41. It will be understood by those skilled in the art that the pressure difference between the swirl chamber 32 and the central swash plate chamber 8 also drives the lubricating oil from the swirl chamber 32 to the central swash plate chamber 8 as described above.

The lubricating oil which flows into the central swash plate chamber 8 is entrained by the low pressure refrigerant gas which will be compressed by and discharged from the compressor. The lubricating oil is removed from the high pressure refrigerant gas by the oil separator 26 as described above.

It will also be understood by those skilled in the art that the forgoing description is a preferred embodiment of the disclosed device and that various changes and modifications may be made without departing from the spirit and scope of the invention.

We claim:

1. A reciprocating piston compressor adapted to receive a low pressure gas from an external circuit, and to supply a high pressure gas to the external circuit, the compressor including:

a cylinder block with front and rear ends, the cylinder block including a central bore extending along the longitudinal axis, and a plurality of axially extending cylinder bores arranged around the central bore, the central bore having an open end at the front end of the cylinder block and an opposite closed end;

housing means, sealingly mounted to the ends of the cylinder block by screw bolts with valve plates clamped between the cylinder block and the housing means;

the cylinder block further including axially extending bolt insertion holes, arranged around the central bore, for receiving the screw bolts, the bolt insertion holes having a diameter larger than that of the screw bolts to define annular spaces between the bolt insertion holes and the screw bolts inserted;

a plurality of double headed pistons slidably provided within the cylinder bores for reciprocation;

an axially extending drive shaft, inserted into the central bore, for driving the motion of the reciprocating pistons;

a pair of radial bearings, provided in the central bore, for rotatably supporting the axially extending drive shaft;

an oil separator, provided between the compressor and the external circuit, for removing lubricating oil in the form of a mist contained in the high pressure gas;

an oil reservoir for accumulating the lubricating oil removed from the high pressure gas by the oil separator, at least a portion of the oil reservoir being provided in the cylinder block adjacent to the closed end of the central bore; and oil passages, provided between the central bore and the oil reservoir, for distributing the lubricating oil to the radial bearings; and the oil passages including an orifice provided in the cylinder block between the closed end of the central bore and the oil reservoir, and a pair of passages extending along the front and rear ends of the cylinder block, one of the pair of passages at the rear end of the cylinder block fluidly connecting at least one of the bolt insertion holes to the oil reservoir and the other passage fluidly connecting the bolt insertion hole to the central bore adjacent to the opening thereof whereby the a portion of the lubricating oil is supplied to the central bore through at least one of the annular spaces between the at least one bolt insertion holes and the screw bolts inserted.

2. A compressor according to claim 1, in which the housing means includes suction and discharge chambers;

the suction chamber being fluidly connected to external circuit and the cylinder bores to receive a low pressure gas from the external circuit and to introduce the low pressure gas into the cylinder bores; and the discharge chamber being fluidly connected to the cylinder bores and the external circuit to receive and direct the high pressure gas compressed in the cylinder bores to the external circuit.

3. A compressor according to claim 2, further comprising an inclined swash plate mounted onto the axially extending drive shaft for rotation with the drive shaft to engage the double-headed pistons, the rotation of the axially extending drive shaft being converted to the reciprocation of the double-headed pistons; and the cylinder block including a central swash plate chamber for accommodating the inclined swash plate, the central swash plate cheer being fluidly connected to the external circuit and the suction chamber to receive the low pressure gas and to introduce the low pressure gas into the suction chambers.

4. A compressor according to claim 3, in which the central swash plate chamber is fluidly connected to the suction chamber through at least one annular space between at least one bolt insertion holes and the screw blots inserted therein.

5. A compressor according to claim 4, in which the inclined swash plate is supported by a pair of thrust bearings provided between the inclined swash plate and the cylinder block inside the radial bearings, the radial and thrust bearings are slide type bearings.

6. A compressor according to claim 5, in which at least one of the remaining bolt insertion holes provides fluid communication between the central swash plate chamber and the suction chamber.

7. A compressor according to claim 6, in which the oil separator including a cylindrical swirl chamber with a cylindrical wall and a circular partition wall provided to divide the swirl chamber into upper and lower chambers, the partition wall including a plurality of apertures along the circumference thereof to provide fluid communication between the upper and lower chambers;

an inlet port for directing the high pressure gas from the discharge chamber into the swirl chamber, the inlet port opening, into the upper cheer of the swirl chamber and at a tangent to the cylindrical wall to promote a swirl flow of the high pressure gas within the upper chamber so that the oil in the form of a mist in the high pressure gas is removed by the centrifugal force on the mist; and a high pressure pipe for directing the high pressure gas from which the lubricating oil is removed.

8. A compressor according to claim 7, in which the lower chamber of the swirl chamber is fluidly connected to the oil reservoir.

9. A compressor according to claim 8, in which the oil reservoir includes a recess provided in the cylinder block adjacent to the closed end of the central bore, a central bore provided in the valve plate between the rear end of the cylinder block and the housing means, and a recess provided in the housing means mounted to the rear end of the cylinder block; and the recess in the cylinder block, the central opening in the valve plate, and the recess in the housing means being aligned to the longitudinal axis of the cylinder block.

* * * * *